United States Patent [19]

Dragoun

[11] 4,069,698

[45] Jan. 24, 1978

[54] ARRANGEMENT FOR FORMING FORM PIECES BY POINT ROLLING

[75] Inventor: Jozef Dragoun, Nove Mesto nad Vahom, Czechoslovakia

[73] Assignee: VUMA Vyskumny ustav mechanizacie a automatizacie, Nove Mesto nad Vahom, Czechoslovakia

[21] Appl. No.: 648,958

[22] Filed: Jan. 14, 1976

Related U.S. Application Data

[63] Continuation-in-part of Ser. No. 629,582, Nov. 6, 1975, abandoned.

[30] Foreign Application Priority Data

Nov. 6, 1974 Czechoslovakia ..... 7551/74

[51] Int. Cl.[2] ..... B21J 15/16

[52] U.S. Cl. ..... 72/67; 72/406

[58] Field of Search ..... 72/67, 406, 429, 112, 72/122, 126

[56] References Cited

U.S. PATENT DOCUMENTS

| | | | |
|---|---|---|---|
| 3,653,243 | 4/1972 | Ramseier | 72/126 |
| 3,703,823 | 11/1972 | Wilson | 72/406 |
| 3,768,289 | 10/1973 | Mink | 72/67 |

*Primary Examiner*—C.W. Lanham
*Assistant Examiner*—Gene P. Crosby

[57] ABSTRACT

Form pieces, particularly rivet heads are formed by point rolling of an active surface of a forming tool along the formed surface by an arrangement wherein the required motion of the forming tool is composed of two components, both of which are derived from rotating motions around an axis coaxial with the axis of the arrangement.

4 Claims, 4 Drawing Figures

ARRANGEMENT FOR FORMING FORM PIECES BY POINT ROLLING

This application is a continuation-in-part of application Ser. No. 629,582 filed Nov. 6, 1975, now abandoned.

BACKGROUND OF THE INVENTION

This invention relates to an arrangement for the forming of form pieces by point rolling of an active surface of a forming tool along the formed surface.

A number of arrangements are known for the forming of form pieces in the direction of the axis of the form piece, wherein an additional movement of the forming tool is used in order to utilize the forming forces more effectively or in order to reduce the forming force. Different kinds of these arrangements, whether they are riveting machines or presses with rocking dies, use different principles of movement of the active surface of the tool with respect to the formed surface.

One of these principles uses a rolling motion of the tool along a circle the center of which lies on the axis of the formed surface, whereby the place of contact of the tool with the formed surface is half the meridian of the formed surface. The direction of flow of the formed material is not the most advantageous in this case for many forming operations due to the tangential character of movement of the tool along the formed surface.

Another kind of arrangement uses a principle of movement of the tool wherein its axis describes a hypocycloid curve, whereby the center of the active surface of the tool is coincident with the center of the formed surface within the whole forming interval. The place of contact of the tool with the formed surface is a rolling curve, the length of which varies from zero to a maximum. The movement of the tool along the formed surface has a radial-tangential character.

Other modifications of these arrangements operate according to the same principle, with the difference that the kinematic coupling is not stable-hypocycloidal, but is free; the movement is composed of two independent movements, the consequence of which is the possibility of variation of the ratio of the radial and tangential components of the movement of the tool.

A drawback of arrangements of this kind is that the individual rolling cycles proceed along the surface of the formed surface, the consequence of which is a certain lateral action on the piece being formed; this can be unwelcome in some cases. A drawback is also that the support of the tool transmitting the forming force is accomplished by a spherical surface, i.e. with the most unfavorable sliding friction. The most convenient of known arrangements are those wherein the additional movement of the tool securing the forming by rolling is based on the principle of a reciprocative point rolling of the active surface of the tool along the meridian of the formed surface. The forming of mostly rotational surfaces by reciprocative point rolling is secured by superposition of a reciprocative rolling upon a rotation of the plane of rolling. An advantage of this principle is the theoretical action of the tool on the formed surface in a point in the course of the whole forming interval, thereby achieving the highest intensity of forming in small volumes, and furthermore the elimination of lateral forces on the form piece within one cycle of the reciprocative rolling motion. Known arrangements for forming by reciprocative point rolling have a lateral drive of the reciprocative movement by a second shaft, with large kinematic couplings, resulting in undesirable larger lateral dimensions of the arrangement.

SUMMARY OF THE INVENTION

It is an object of this invention to provide an arrangement of this kind which is simple in design, reliable in operation, with limited lateral dimensions.

The arrangement for the forming of form pieces by reciprocal point rolling of a forming tool along the formed surface is provided with a rotating body on the axis of which there is situated a shaft provided with an upper and lower eccentric cam. An upper sliding piece, in engagement with the upper eccentric cam, is connected by means of upper bolts and upper sliding shoes with a rocking element. A lower sliding piece, in engagement with the lower eccentric cam, is also connected to the rocking element by means of bolts and sliding shoes. At least one of these sliding pieces is guided in a sliding guiding of the rotating body.

With the arrangement according to this invention, the drives of the various movements are situated on the axis of the arrangement, reducing thereby its dimensions and improving the kinematic coupling of operating elements and the adaptibility of the arrangement for different machine units.

DESCRIPTION OF DRAWINGS

An exemplary embodiment of an arrangement according to this invention is shown in the attached drawings, wherein.

DESCRIPTION OF PREFERRED EMBODIMENT

Figure 1:
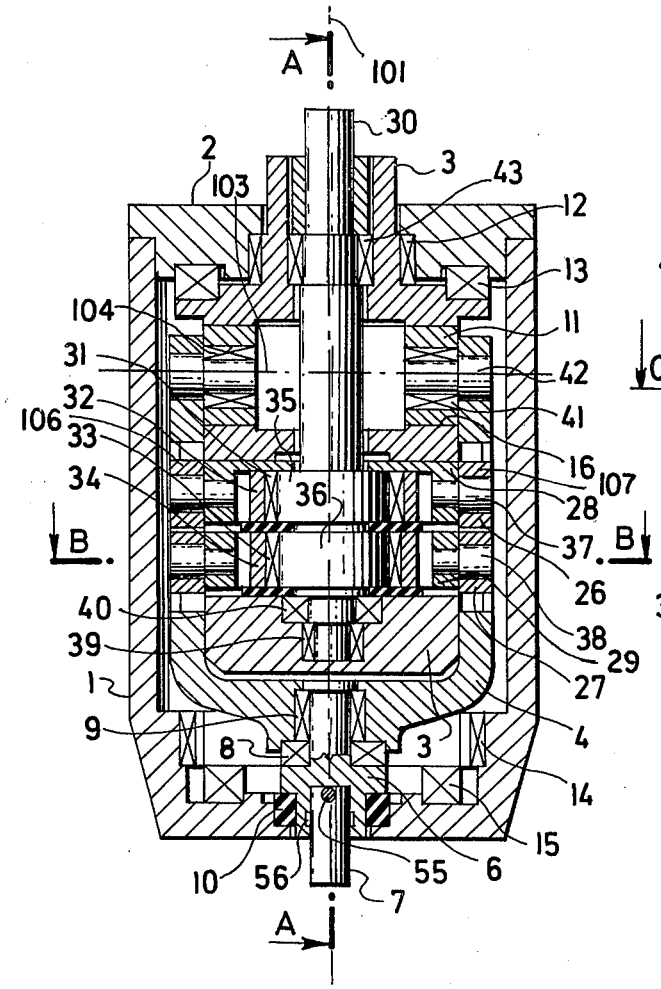
FIG. 1 is an elevation in longitudinal section of a point-contact forming tool mount adapted for effecting a rocking motion of a forming tool about an axis of the mount.

The arrangement for forming of form pieces by point rolling shown in the drawings comprises a fixed case 1 having an axis 101 and provided with a cover affixed thereto, wherein a segmented rotating body 3 is rotatably supported in the case 1 by a lower axial bearing 15 and in a lower radial bearing 14. The rotating body 3 is by its upper part supported in an upper axial bearing 13 and in an upper radial bearing 12 situated in the cover 2 of case 1. The body 3 has disposed in an upper part thereof a rolling track 16 (FIG. 2) which extends generally transversely through the axis 101 along a slightly arcuate path 102. A pair of aligned rollers 11, having a common axis 103 (FIG. 1), are captured within the rolling track 16, and are adapted to roll therein between a first position of maximum displacement shown in FIG. 2 to a second position of maximum displacement represented by the mirror image of the position shown in FIG. 2 about the axis 101.

The rollers 11 have aligned bores 104 therein for receiving a pair of roller bearings 41. Aligned bolts 42, affixed to the upper end of a pair of upwardly extending outer arms 106, 107 of a U-shaped rocking element 4 are mounted within roller bearings 42 positioned in the bores 41. The lower portion of the rocking element 4 is supported in the case below the body 3, and the outer arms 106, 107 thereof extend on opposite sides of the body 3.

As shown best in FIG. 2, the body 3 has a second cutout region 108 disposed below the rolling track 16, the cutout 108 having an upper, generally planar guide surface 57 that extends transversely through the longitudinal axis 101 in a direction perpendicular to the plane of the drawing as viewed in FIG. 1. A sliding element 28, which is coupled to intermediate portions of the outer legs 106, 107 of the rocking element 4 by means of bolts 37, is slidably received in the cutout 108 for reciprocation along the groove 57, with the length of the path of reciprocation being greater than the arcuate path of movement of the rollers 11 in the rolling track 16.

Since the roller 11, to which the upper end of the rocking element 4 is coupled, is constrained to move for a short distance in an arcuate path, and since the sliding element 28 to which an intermediate portion of the element 4 is coupled is restricted for movement in a linear path, a lateral displacement of the sliding element 28 in the manner described below will cause the lower end of the element 4 to be tilted in the direction of displacement of the sliding piece 28, in the manner depicted in FIG. 2. Thus, a reciprocation of the sliding piece 28 in the groove 57 will cause a rocking motion of the lower portion of the element 4 back and forth through the axis 101 in the plane of displacement of the element 28. Since the locus of the roller 11 during the displacement of the element 28 is an arc rather than a fixed pivot point, it follows that a tool 7, carried in a tool holder 6 rotatably supported in the lower portion of the rocking element 4, will define a point-contact rolling movement over a surface of a workpiece (not shown) to be contoured by the tool 7.

An element 29, substantially identical to the sliding element 28 except for the portion of the element 28 in engagement with the groove 57, is disposed immediately below the element 28 within the cutout 108 of the body 3. The element 29 is secured by bolts 38 to the outer arms 106, 107 of the rocking element 4. As a result, a transverse displacement of the sliding element 28 will result in a corresponding displacement of the element 29.

Figure 2:
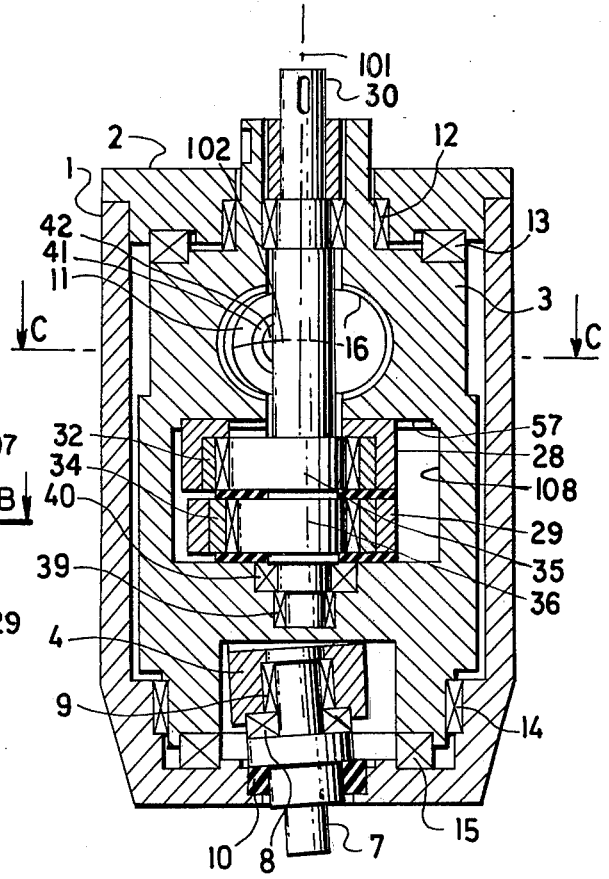
FIG. 2 is a side view in longitudinal section along a plane indicated in FIG. 1 by the line A—A, illustrating the position of the mount when the tool holder is disposed at one extreme of its rocking motion.
Figure 3:
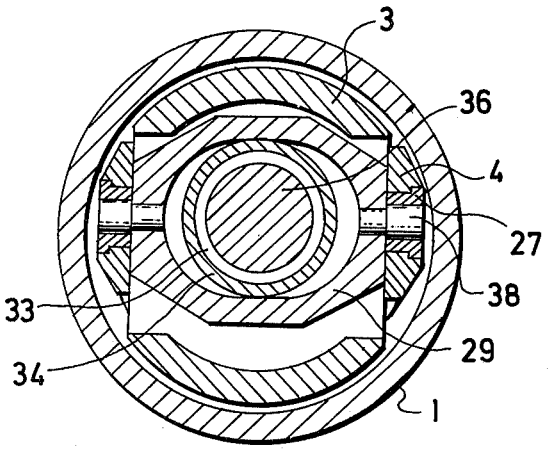
FIG. 3 is a cross-sectional view along a plane indicated in FIG. 1 by the line B—B.
Figure 4:
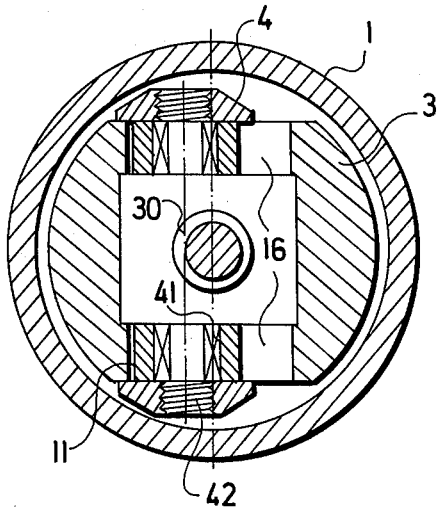
FIG. 4 is a cross-sectional view along a plane indicated in FIG. 2 by the line C—C.

Any binding of the rocking element 4 during lateral displacement of the sliding piece 28, which would otherwise occur because of the constraining effect of the overlying arcuate path of the rollers 11, can be prevented by providing respective sliding shoes 26 between the opposed bolts 37 and the associated portions of the rocking element arms 106, 107, and by further providing respective sliding shoes 27 between the opposed bolts 38 and the associated portions of the arms 106, 107, as indicated in FIG. 1.

A shaft 30 with eccentric cams 35 and 36, affixed thereto is provided to effect the above-mentioned reciprocation of the elements 28, 29 and thereby a rocking motion of the element 4 through the axis 101. The shaft 30 is supported for rotation in the rotating body 3 in a lower bearing 39, in an axial bearing 40 and in an upper bearing 43. The motion of the shaft 30 is converted by the cams into the transverse reciprocation of the elements 28, 29. To effect this, the upper sliding piece 28 is in engagement with a rolling ring 32 which is carried in the upper eccentric cam 35 by means of a bearing 31. Similarly the lower sliding piece 29 is in engagement with a rolling ring 34 which is carried in the lower eccentric cam 36 by means of a bearing 33. The holder 6, with the tool 7 fixed therein by a transverse bolt 55 and by a safety ring 56, is supported in the rocking element 4 by a radial bearing 9 and an axial bearing 8. The tool holder 6 is in addition firmly held in an elastic ring 10 in case 1.

Due to the rotatable supporting of the tool holder 6 in the rocking element 4 and due to its stable support by the elastic ring 10, and also due to the fact that tool 7 is fixed by a transverse bolt 55 and by a safety ring 56, the tool 7 is prevented from rotating, thereby achieving its uniform wear and safety in operation. The rotation of the plane of rocking of the element 4 through the axis 101, and thereby of the reciprocating rolling motion of the tool 7 to form a contoured surface on a workpiece (not shown) along its meridian, is accomplished by rotation of rotating body 3 about the axis 101 while the shaft 30 is simultaneously rotated. With this arrangement, after one rotation of the body 3, every meridian on the associated workpiece will have come into point contact with the tool 7 to be shaped thereby. The ratio of the number of reciprocating rolling motions and of revolutions of the rotating body 3 can be chosen arbitrarily since the rotating body 3 and the shaft 30 with eccentric cams have individual drives. This enables the choosing of optimum conditions for different materials and different forming operations.

Other constructional arrangements can obviously be employed within the scope of this invention. The invention can be particularly utilized for forming of closing heads of rivets of different shape, for different operations in assembling such as flashing and the like and for the forming of different form pieces.

Although the invention is illustrated and described with reference to one preferred embodiment thereof, it is to be expressly understood that it is in no way limited by the disclosure of such a single preferred embodiment, but is capable of numerous modifications within the scope of the appended claims.

What is claimed is:

1. In an apparatus for shaping a surface on a workpiece by point rolling of an active contact surface of an overlying forming tool along the surface, an elongated hollow case having a first axis, an elongated hollow body extending downwardly through the case and supported for rotation about the first axis, the body having disposed therein a first relatively long guide path extending transversely through the first axis and a second relatively short guide path disposed above the first guide path and extending transversely through the first axis, first guide means supported for transverse movement in the body along the first guide path, second guide means supported for movement in the body along the second guide path, a rocking element disposed substantially within the case below the body and having at least one integral extension projecting upwardly in the case along the body, means for connecting an intermediate portion of the integral extension to the first guide means, means for connecting an upper portion of the integral extension to the second guide means, a shaft extending downwardly through the body concentric with the first axis and supported for rotation about the first axis, whereby the body and the shaft may be independently rotated, cam means affixed to the shaft within the body and engageable with the first guide means for reciprocating the first guide means, and imparting a rocking motion to the element through the first axis, in response to a rotation of the shaft, and means for coupling the forming tool to the lower portion of the rocking element.

2. Apparatus as defined in claim 1, in which the second guide path is a rolling track, and in which the second guide means comprises at least one roller supported for movement in the rolling track.

3. Apparatus as defined in claim 1, in which the forming tool coupling means comprises, in combination, a tool holder rotatably supported in the lower portion of the rocking element, and means for supporting the forming tool in the tool holder.

4. Apparatus as defined in claim 1, further comprising means carried in the lower portion of the case for resiliently retaining the tool holder during a rocking motion of the rocking element.

* * * * *